US010907109B2

(12) United States Patent
Al-Majnouni et al.

(10) Patent No.: US 10,907,109 B2
(45) Date of Patent: Feb. 2, 2021

(54) INTEGRATION OF CATALYTIC CRACKING PROCESS WITH CRUDE CONVERSION TO CHEMICALS PROCESS

(71) Applicant: SABIC Global Technologies B.V., Bergen op Zoom (NL)

(72) Inventors: Khalid A. Al-Majnouni, Riyadh (SA); Naif Aldalaan, Riyadh (SA); Ahmed Al-Zenaidi, Riyadh (SA); Nabil Al-Yassir, Riyadh (SA)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 0 days.

(21) Appl. No.: 16/474,124

(22) PCT Filed: Mar. 8, 2018

(86) PCT No.: PCT/IB2018/051529
§ 371 (c)(1),
(2) Date: Jun. 27, 2019

(87) PCT Pub. No.: WO2018/163107
PCT Pub. Date: Sep. 13, 2018

(65) Prior Publication Data

US 2019/0316047 A1 Oct. 17, 2019

Related U.S. Application Data

(60) Provisional application No. 62/469,427, filed on Mar. 9, 2017.

(51) Int. Cl.
*C10G 55/06* (2006.01)

(52) U.S. Cl.
CPC ..... *C10G 55/06* (2013.01); *C10G 2400/02* (2013.01); *C10G 2400/20* (2013.01)

(58) Field of Classification Search
CPC ..... C10G 55/06; C10G 55/02; C10G 55/00
See application file for complete search history.

(56) References Cited

U.S. PATENT DOCUMENTS 4,830,728 A 5/1989 Herbst et al. ..... 208/78
8,153,851 B2 4/2012 Gartside et al. ..... 585/324
(Continued)

FOREIGN PATENT DOCUMENTS

CN 100554229 C 10/2009
EP 1063274 A1 * 12/2000 ..... C10G 11/05
(Continued)

OTHER PUBLICATIONS

International Search Report and Written Opinion from PCT/IB2018/051529 dated May 17, 2018, 9 pages.

*Primary Examiner* — Youngsul Jeong
(74) *Attorney, Agent, or Firm* — Norton Rose Fulbright US LLP

(57) ABSTRACT

A method that integrates a catalytic cracking process with a crude oil conversion to chemicals process is disclosed. The method may include contacting, in a catalytic cracking reactor, a mixture of the hydrocarbon stream comprising primarily $C_5$ and $C_6$ hydrocarbons from crude oil processing and a $C_4$ to $C_5$ hydrocarbon stream produced in a steam cracking unit with a catalyst under reaction conditions sufficient to produce an effluent comprising olefins.

13 Claims, 2 Drawing Sheets

(56) References Cited

U.S. PATENT DOCUMENTS

| | | | | |
|---|---|---|---|---|
| 8,293,961 | B2 | 10/2012 | Choi et al. | 585/651 |
| 8,324,441 | B2 | 12/2012 | Wegerer et al. | 585/648 |
| 2008/0035527 | A1* | 2/2008 | Eng | C10G 11/182 208/113 |
| 2011/0240523 | A1 | 10/2011 | Mandal et al. | 208/120.01 |

FOREIGN PATENT DOCUMENTS

| | | | |
|---|---|---|---|
| EP | 1063274 | A1 | 12/2000 |
| EP | 2660288 | A1 | 11/2013 |
| WO | WO 2016/059568 | | 4/1916 |
| WO | WO 2006/098712 | | 9/2006 |
| WO | WO 2007/047941 | | 4/2007 |
| WO | WO 2013/016660 | | 1/2013 |
| WO | WO 2013/142609 | | 9/2013 |
| WO | WO 2015/000844 | | 1/2015 |
| WO | WO 2015/000850 | | 1/2015 |

* cited by examiner

INTEGRATION OF CATALYTIC CRACKING PROCESS WITH CRUDE CONVERSION TO CHEMICALS PROCESS

CROSS REFERENCE TO RELATED APPLICATIONS

This application is a national phase application under 35 U.S.C. § 371 of International Application No. PCT/IB2018/051529 filed Mar. 8, 2018, which claims priority to U.S. Provisional Patent Application No. 62/469,427 filed Mar. 9, 2017. The entire contents of each of the above-referenced disclosures is specifically incorporated by reference herein without disclaimer.

FIELD OF INVENTION

The present invention generally relates to the processing of hydrocarbon streams to form more valuable hydrocarbons. More specifically, the present invention relates to the integration of a process that cracks hydrocarbons to form lighter hydrocarbons and a process that converts crude oil into chemicals.

BACKGROUND OF THE INVENTION

Distilling crude oil to produce products such as butane (or lighter hydrocarbons), straight run gasoline, naphtha, kerosene, light gas oil, heavy gas oil, and straight run residue is simply separating the crude oil into its various constituents. Thus, under set processing conditions, the relative proportions of the products produced from a particular type of crude oil will roughly remain constant. However, based on market demands, it may be more economical to be able to increase the proportion of one or more of the products at the expense of other products. For example, when the demand for gasoline is high, it may be more economical to produce more gasoline than heavy gas oil. Thus, processes have been developed to convert one type of distilled product to another. One such process is catalytic cracking, in which longer and heavier hydrocarbon molecules are contacted with a catalyst at high temperatures and pressures to break them into lighter and shorter hydrocarbon molecules.

A petrochemicals complex typically involves deriving feedstocks from crude oil and cracking those feedstocks to produce olefins such as ethylene. Ethylene is a building block for various petrochemicals. The cracking to produce ethylene is usually carried out in steam crackers. In the steam cracking (pyrolysis) process, the hydrocarbons are superheated in a reactor to temperatures as high as 750-950° C. For the cracking process, a dilution steam generator (DSG) supplies dilution steam to the reactor to reduce the partial pressure of the hydrocarbons. The superheated hydrocarbons are then rapidly cooled (quenched) to stop the reactions after a certain point to optimize cracking product yield. The quenching of the superheated gas in many processes is carried out using water in a quench water tower (QWT). The superheated cracked gas is flowed into the bottom of the quench water tower and, at the same time, water is sprayed into the top of the quench water tower. As the water in the quench water tower falls, it makes contact with the upwardly flowing superheated cracked gas and, in that way, cools the superheated cracked gas and dilution steam. The cracked gas is subjected to a series of separation processes to recover products such as ethylene and propylene.

BRIEF SUMMARY OF THE INVENTION

A method has been discovered that integrates a catalytic cracking process with a crude oil conversion to chemicals process. The proposed method involves the processing of light naphtha and its integration with a steam cracking process. The catalytic cracking may produce light olefins, dry gases and other heavier components in a reactor (e.g., a fluidized bed reactor or a fixed bed reactor). The conversion of crude oil to chemicals process may involve the steam cracking of hydrocarbon feedstock to form olefins such as ethylene.

Embodiments of the invention include a method of producing olefins. The method may include processing crude oil to produce a plurality of streams that include a hydrocarbon stream comprising primarily $C_5$ and $C_6$ hydrocarbons. The method may further include receiving, in a catalytic cracking reactor, the hydrocarbon stream comprising primarily $C_5$ and $C_6$ hydrocarbons. The method may further include receiving, in the catalytic cracking reactor, a $C_4$ to $C_5$ hydrocarbon stream produced in a steam cracking unit and contacting, in the catalytic cracking reactor, a mixture of the hydrocarbon stream comprising primarily $C_5$ and $C_6$ hydrocarbons and the $C_4$ to $C_5$ hydrocarbon stream produced in the steam cracking unit with a catalyst under reaction conditions sufficient to produce an effluent comprising olefins. The method may also include separating the effluent to produce at least a first product stream comprising $C_2$ to $C_4$ olefins, a second product stream comprising $C_2$ to $C_4$ paraffins, and a third product stream comprising $C_{5+}$-gasoline.

The following includes definitions of various terms and phrases used throughout this specification.

The terms "about" or "approximately" are defined as being close to as understood by one of ordinary skill in the art. In one non-limiting embodiment the terms are defined to be within 10%, preferably, within 5%, more preferably, within 1%, and most preferably, within 0.5%.

The terms "wt. %", "vol. %" or "mol. %" refers to a weight, volume, or molar percentage of a component, respectively, based on the total weight, the total volume, or the total moles of material that includes the component. In a non-limiting example, 10 moles of component in 100 moles of the material is 10 mol. % of component.

The term "substantially" and its variations are defined to include ranges within 10%, within 5%, within 1%, or within 0.5%.

The terms "inhibiting" or "reducing" or "preventing" or "avoiding" or any variation of these terms, when used in the claims and/or the specification, includes any measurable decrease or complete inhibition to achieve a desired result.

The term "effective," as that term is used in the specification and/or claims, means adequate to accomplish a desired, expected, or intended result.

The term "primarily" means greater than 50%, e.g., 50.01-100%, or any range between, e.g., 51-95%, 75%-90%, at least 60%, at least 70%, at least 80% etc.

The use of the words "a" or "an" when used in conjunction with the term "comprising," "including," "containing," or "having" in the claims or the specification may mean "one," but it is also consistent with the meaning of "one or more," "at least one," and "one or more than one."

The words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The process of the present invention can "comprise," "consist essentially of," or "consist of" particular ingredients, components, compositions, etc., disclosed throughout the specification.

In the context of the present invention, twenty embodiments are now described. Embodiment 1 is a method of producing olefins. The method includes the steps of processing crude oil to produce a plurality of streams that include a hydrocarbon stream containing primarily $C_5$ and $C_6$ hydrocarbons; receiving, in a catalytic cracking reactor, the hydrocarbon stream containing primarily $C_5$ and $C_6$ hydrocarbons; receiving, in the catalytic cracking reactor, a $C_4$ to $C_5$ hydrocarbon stream produced in a steam cracking unit; contacting, in the catalytic cracking reactor, a mixture of the hydrocarbon stream containing primarily $C_5$ and $C_6$ hydrocarbons and the $C_4$ to $C_5$ hydrocarbon stream produced in the steam cracking unit with a catalyst under reaction conditions sufficient to produce an effluent containing olefins; and separating the effluent to produce at least a first product stream containing $C_2$ to $C_4$ olefins, a second product stream containing $C_2$ to $C_4$ paraffins, and a third product stream containing $C_{5+}$-gasoline. Embodiment 2 is the method of embodiment 1 further including receiving, in the catalytic cracking reactor, material containing a coke precursor; and contacting, in the catalytic cracking reactor, a mixture containing (1) the hydrocarbon stream containing primarily $C_5$ and $C_6$ hydrocarbons, (2) the $C_4$ to $C_5$ hydrocarbon stream produced in the steam cracking unit, and (3) the material containing the coke precursor with the catalyst under reaction conditions sufficient to produce coke and the effluent containing olefins. Embodiment 3 the method of embodiment 2, wherein the material containing the coke precursor contains fuel oil, diolefin, or both, from the steam cracking unit. Embodiment 4 the method of any of embodiment 3, wherein material containing the coke precursor contains the diolefins, and the diolefins includes butadiene. Embodiment 5 the method of any of embodiments 1 to 4, wherein the catalytic cracking reactor is a member selected from group consisting of: a fixed bed reactor, a moving bed reactor, a fluidized bed reactor, and combinations thereof. Embodiment 6 the method of any of embodiments 1 to 5, wherein the catalytic cracking reactor is a fluidized bed reactor. Embodiment 7 the method of embodiment 6 wherein the fluidized bed reactor includes a member selected from the group consisting of consisting of a riser, a downer, multiple risers, and multiple downers, and combinations thereof. Embodiment 8 the method of any of embodiments 6 and 7, wherein residence time in the fluidized bed reactor is in a range of 1 to 10 seconds. Embodiment 9 the method of any of embodiments 6 to 8, wherein a ratio of total hydrocarbon to catalyst in the fluidized bed reactor is 2 to 40 wt. %. Embodiment 10 the method of any of embodiments 1 to 5, wherein the catalytic cracking reactor is a fixed bed reactor system. Embodiment 11 the method of embodiment 10 wherein the fixed bed reactor system includes at least one member from the group consisting of a single fixed bed reactor, multiple reactors arranged in series and multiple reactors arranged in parallel. Embodiment 12 the method of any of embodiments 10 and 11, wherein the reaction conditions include a weight hourly space velocity WHSV in a range of 3 to 40 $hr^{-1}$. Embodiment 13 the method of any of embodiments 1 to 12, wherein the reaction conditions include a reaction temperature in a range of 500° C. to 700° C. Embodiment 14 the method of any of embodiments 1 to 13, wherein the reaction conditions include a reaction pressure in a range of 0.5 bars to 5 bars. Embodiment 15 the method of any of embodiments 1 to 14, wherein the catalyst includes at least one solid acid based zeolite catalyst selected from the group consisting of one or more medium pore zeolites, including ZSM-5 and modified ZSM-5; one or more large pore zeolites, including zeolite Y and ultra-stable zeolite Y. Embodiment 16 the method of any of embodiments 1 to 15, wherein the separating of the effluent further includes the step of producing a dry gas stream. Embodiment 17 the method of embodiment 16, wherein the dry gas stream contains methane, hydrogen, or both. Embodiment 18 the method of any of embodiments 1 to 17 further including the step of recycling a $C_5$ to $C_7$ hydrocarbon stream separated from the effluent to the catalytic cracking reactor. Embodiment 19 the method of any of embodiments 1 to 18, wherein yield of light olefins ($C_2$ to $C_4$) is in a range of 25 to 65 wt. %. Embodiment 20 is the method of any of embodiments 1 to 18, wherein yield of light olefins ($C_2$ to $C_4$) is in a range of 35 to 65 wt. %.

Other objects, features and advantages of the present invention will become apparent from the following figures, detailed description, and examples. It should be understood, however, that the figures, detailed description, and examples, while indicating specific embodiments of the invention, are given by way of illustration only and are not meant to be limiting. Additionally, it is contemplated that changes and modifications within the spirit and scope of the invention will become apparent to those skilled in the art from this detailed description. In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

For a more complete understanding, reference is now made to the following descriptions taken in conjunction with the accompanying drawings, in which.

DETAILED DESCRIPTION OF THE INVENTION

A method has been discovered that integrates a catalytic cracking process with a crude oil conversion to chemicals process. The catalytic cracking may produce light olefins, dry gases and other heavier components in a reactor (e.g., a fluidized bed reactor or a fixed bed reactor). The conversion of crude oil to chemicals process may involve the steam cracking of hydrocarbon feedstock to form olefins such as ethylene.

Embodiments of the invention include a method of producing olefins such as $C_2$ to $C_4$ olefins. The method may include processing crude oil in a pretreatment and distillation unit to produce a plurality of streams that include a hydrocarbon stream including primarily $C_5$ and $C_6$ hydrocarbons. The hydrocarbon stream including primarily $C_5$ and $C_6$ hydrocarbons is called a light naphtha stream. The method may further include receiving, in a catalytic cracking reactor unit, the hydrocarbon stream including primarily $C_5$ and $C_6$ hydrocarbons. The catalytic cracking reactor unit may include one or more fixed bed reactors, moving bed reactors, fluidized bed reactors, or combinations thereof.

The method may further include receiving, in the catalytic cracking reactor unit, a $C_4$ to $C_5$ hydrocarbon stream produced in a steam cracking unit and contacting, in the catalytic cracking reactor unit, a mixture of the hydrocarbon stream comprising primarily $C_5$ and $C_6$ hydrocarbons and the $C_4$ to $C_5$ hydrocarbon stream produced in the steam cracking unit (e.g., of a petrochemicals plant that produces ethylene) with a catalyst under reaction conditions sufficient to produce an effluent comprising olefins. The method may also include separating the effluent to produce at least a first product stream comprising light olefins ($C_2$ to $C_4$ olefins), a second product stream comprising $C_2$ to $C_4$ paraffins, and a third product stream comprising $C_{5+}$-gasoline.

Figure 1:
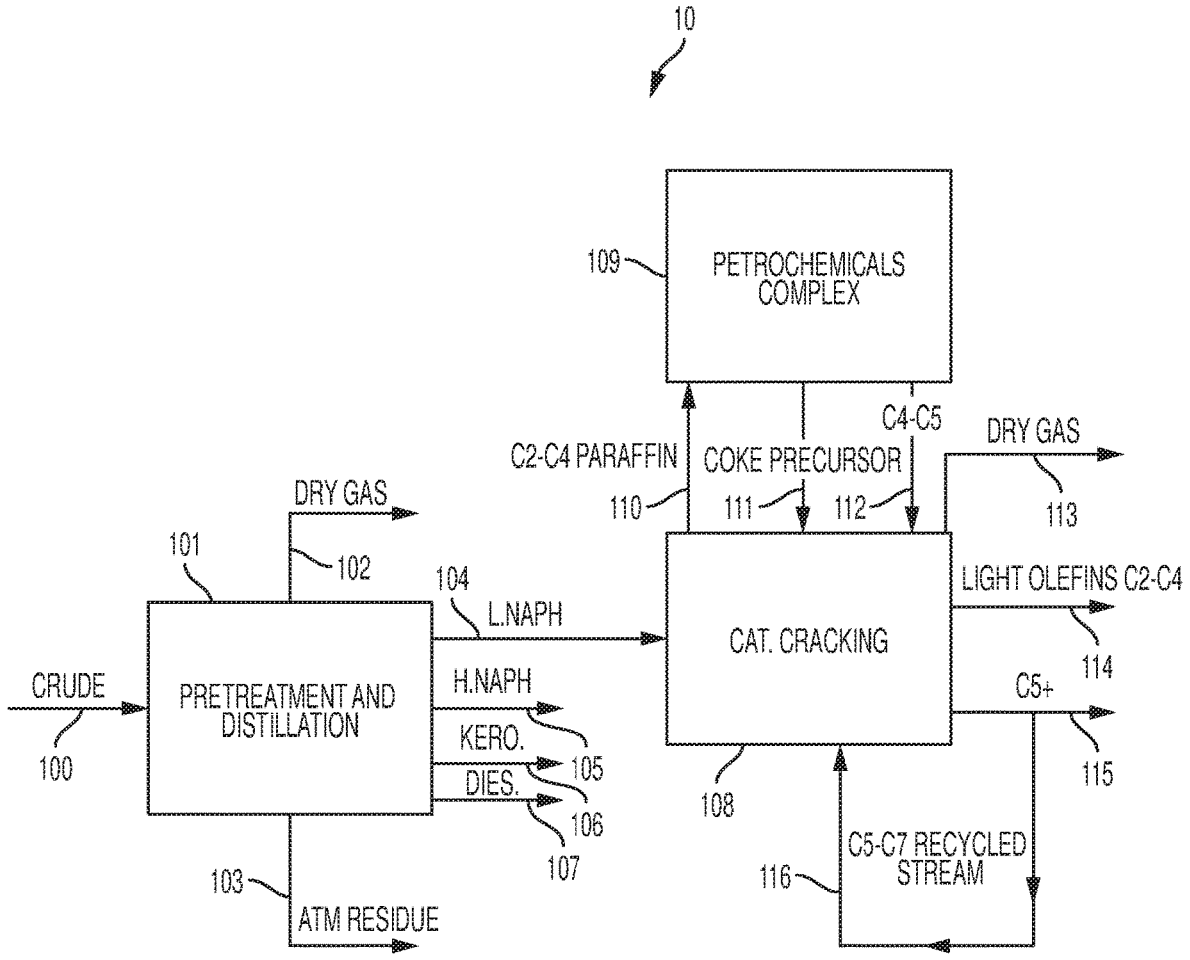
FIG. 1 shows a system that integrates a catalytic cracking process with a crude oil conversion to chemicals process, according to embodiments of the invention.
Figure 2:
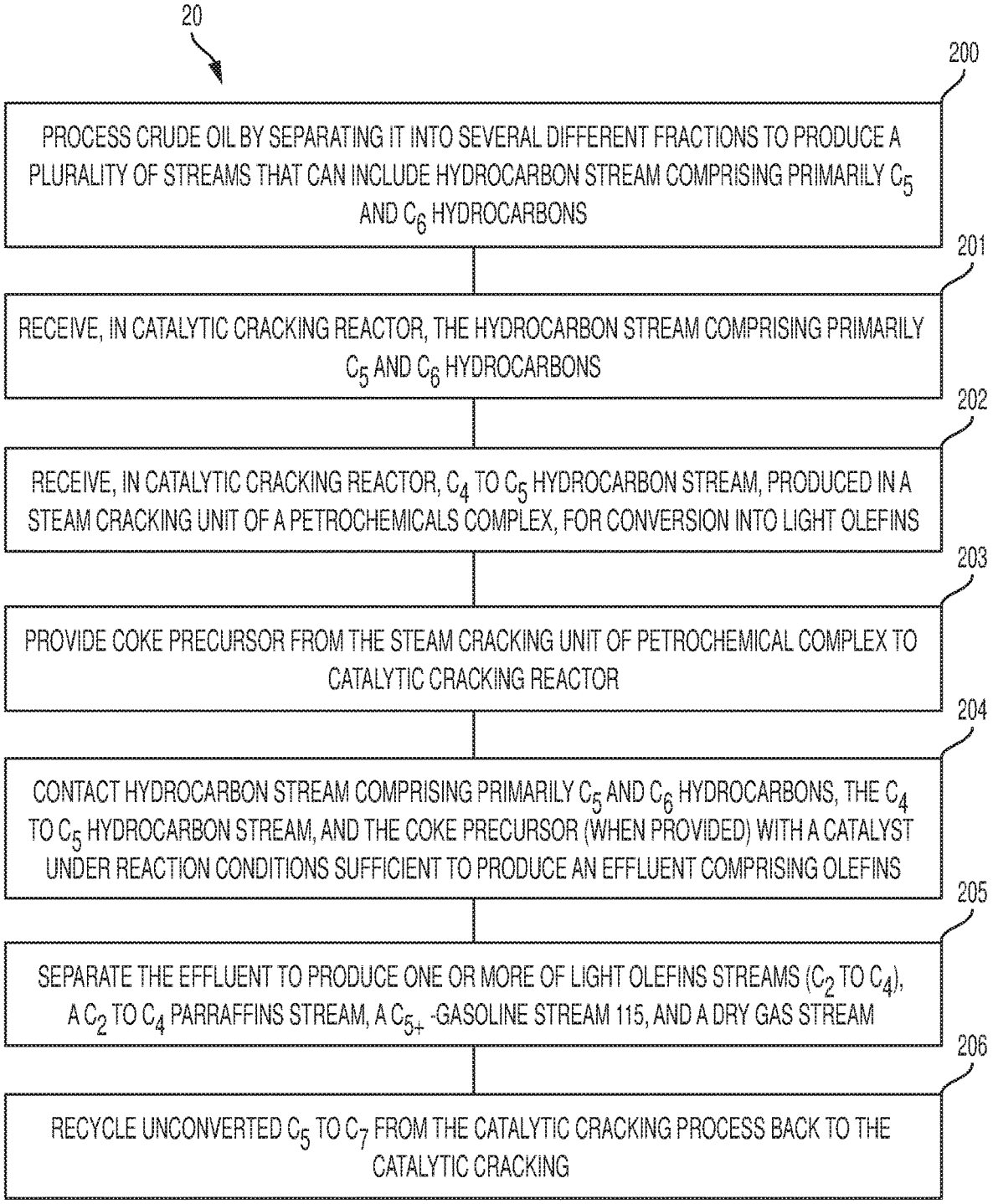
FIG. 2 shows a method that integrates a catalytic cracking process with a crude oil conversion to chemicals process, according to embodiments of the invention.

FIG. 1 shows system 10, which integrates a catalytic cracking process with a crude oil conversion to chemicals process, according to embodiments of the invention. FIG. 2 shows method 20, which integrates a catalytic cracking process with a crude oil conversion to chemicals process, according to embodiments of the invention. Method 20 may be implemented using system 10.

Referring to FIG. 1, crude oil 100 is fed to pretreatment and distillation unit 101, which can process crude oil 100 by separating it into several different fractions to produce a plurality of streams that can include a hydrocarbon stream that includes primarily $C_5$ and $C_6$ hydrocarbons (e.g., light naphtha stream 104), as shown in block 200 of method 20. The separation into different fractions can take place in a single distillation or multiple distillation units of pretreatment and distillation unit 101. Some of the distilled streams from crude oil 100 may be processed in a steam cracking process. Processing of crude oil 100 by pretreatment and distillation unit 101 can also produce heavy naphtha stream 105, kerosene stream 106, diesel stream 107, and ATM residue 103. Embodiments of the invention described herein show a process of converting light naphtha into light olefins and how this process can be integrated with a steam cracking process. Heavy naphtha, for example, can be reformed to produce benzene, toluene and xylenes which are basic building block chemicals for the petrochemical industries.

FIG. 1 further shows light naphtha stream 104 being fed to catalytic cracking reactor 108. In this way, system 10 implements block 201 of method 20, which involves receiving, in catalytic cracking reactor 108, the hydrocarbon stream comprising primarily $C_5$ and $C_6$ hydrocarbons (light naphtha stream 104). Block 202 of method 20, when implemented using system 10, may involve receiving, in catalytic cracking reactor 108, $C_4$ to $C_5$ hydrocarbon stream 112, produced in a steam cracking unit of petrochemicals complex 109. The $C_4$ to $C_5$ hydrocarbon stream 112, in system 10, is for conversion into light olefins.

Method 20, when implemented using system 10, may also include, at block 203, providing coke precursor 111 from the steam cracking unit of petrochemical complex 109 to catalytic cracking reactor 108. Providing coke precursor 111 in this way can enhance heat balance and increase the amount of coke produced in catalytic cracking reactor 108. Coke precursor 111 may include fuel oil, portion of $C_{9+}$ pygas, and/or a diolefin such as a stream of butadiene from the steam cracking unit of petrochemical complex 109.

According to embodiments of the invention, catalytic cracking reactor 108 is adapted to carry out block 204 of method 20, which involves contacting a mixture of light naphtha stream 104 (comprising primarily $C_5$ and $C_6$ hydrocarbons), $C_4$ to $C_5$ hydrocarbon stream 112, and coke precursor 111 (when provided) with a catalyst under reaction conditions sufficient to produce an effluent comprising olefins. Catalytic cracking reactor 108 can include one or more of fixed bed reactors, moving bed reactors, and fluidized bed reactors, or combinations thereof, for cracking light naphtha stream 104.

Method 20, as implemented by system 10, may further include block 205, which involves separating the effluent to produce one or more of light olefins stream 114 ($C_2$ to $C_4$ olefins), $C_2$ to $C_4$ paraffins stream 110, $C_{5+}$-gasoline stream 115, and dry gas stream 113. In embodiments of the invention, dry gas stream 113 includes methane and/or hydrogen. In embodiments of the invention, $C_2$ to $C_4$ paraffins stream 110 is sent to petrochemicals complex 109, where it is used to produce more olefins in the steam cracking furnace. The products separation and olefins recovery processes are known to those of ordinary skill in the art. The petrochemicals complex and catalytic cracking can share the same separation units.

FIG. 2 shows that method 20 may further include, at block 206, recycling unconverted $C_5$ to $C_7$ from the catalytic cracking of light naphtha stream 104 back to catalytic cracking reactor 108. As shown in FIG. 1, recycled stream 116 may be a portion of $C_{5+}$ gasoline stream 115.

In embodiments of the invention, catalytic cracking reactor 108 is a fluidized bed reactor that is configured to include a selection from the list consisting of: a riser, a downer, multiple risers, and multiple downers, and combinations thereof. When the catalytic cracking reactor 108 is a fluidized bed reactor, in embodiments of the invention, the residence time in the fluidized bed reactor may be in a range of 1 to 10 second, and all ranges and values there between including values 1 seconds, 2 seconds, 3 seconds, 4 seconds, 5 seconds, 6 seconds, 7 seconds, 8 seconds, 9 seconds, and 10 seconds. Further, in embodiments of the invention, when catalytic cracking reactor 108 is a fluidized bed reactor, a ratio of total hydrocarbon to catalyst in the fluidized bed reactor may be in a range of 2 to 40 wt. %, and all ranges and values there between including ranges 2 wt. % to 10 wt. %, 10 wt. % to 20 wt. %, 20 wt. % to 30 wt. %, 30 wt. % to 40 wt. % and values 3 wt. %, 4 wt. %, 5 wt. %, 6 wt. %, 7 wt. %, 8 wt. %, 9 wt. %, 10 wt. %, 11 wt. %, 12 wt. %, 13 wt. %, 14 wt. %, 15 wt. %, 16 wt. %, 17 wt. %, 18 wt. %, 19 wt. %, 20 wt. %, 21 wt. %, 22 wt. %, 23 wt. %, 24 wt. %, 25 wt. %, 26 wt. %, 27 wt. %, 28 wt. %, 29 wt. %, 30 wt. %, 31 wt. %, 32 wt. %, 33 wt. %, 34 wt. %, 35 wt. %, 36 wt. %, 37 wt. %, 38 wt. %, 39 wt. %, and 40 wt. %.

In embodiments of the invention, catalytic cracking reactor 108 is a fixed bed reactor system that is configured to include a selection from the list consisting of: a single fixed bed reactor, multiple reactors arranged in series, multiple reactors arranged in parallel, and combinations thereof. When catalytic cracking reactor 108 is a fluidized bed reactor, in embodiments of the invention, the reaction conditions include a weight hourly space velocity WHSV in a range of 3 to 40 $hr^{-1}$, and all ranges and values there between including values 3 $hr^{-1}$, 4 $hr^{-1}$, 5 $hr^{-1}$, 6 $hr^{-1}$, 7 $hr^{-1}$, 8 $hr^{-1}$, 9 $hr^{-1}$, 10 $hr^{-1}$, 11 $hr^{-1}$, 12 $hr^{-1}$, 13 $hr^{-1}$, 14 $hr^{-1}$, 15 $hr^{-1}$, 16 $hr^{-1}$, 17 $hr^{-1}$, 18 $hr^{-1}$, 19 $hr^{-1}$, and 20 $hr^{-1}$.

In embodiments of the invention, for example, when catalytic cracking reactor 108 includes one or more of a fluidized bed reactor, a moving bed reactor, and a fixed bed reactor, the reaction conditions may include a reaction temperature in a range of 500° C. to 700° C., and all ranges and values there between including ranges 500° C. to 505° C., 505° C. to 510° C., 510° C. to 515° C., 515° C. to 520°

C., 520° C. to 525° C., 525° C. to 530° C., 530° C. to 535° C., 535° C. to 540° C., 540° C. to 545° C., 545° C. to 550° C., 550° C. to 555° C., 555° C. to 560° C., 560° C. to 565° C., 565° C. to 570° C., 570° C. to 575° C., 575° C. to 580° C., 580° C. to 585° C., 585° C. to 590° C., 590° C. to 595° C., 595° C. to 600° C., 600° C. to 605° C., 605° C. to 610° C., 610° C. to 615° C., 615° C. to 620° C., 620° C. to 625° C., 625° C. to 630° C., 630° C. to 635° C., 635° C. to 640° C., 640° C. to 645° C., 645° C. to 650° C., 650° C. to 655° C., 655° C. to 660° C., 660° C. to 665° C., 665° C. to 670° C., 670° C. to 675° C., 675° C. to 680° C., 680° C. to 685° C., 685° C. to 690° C., 690° C. to 695° C., and 695° C. to 700° C. Further, those reaction conditions may include a pressure in a range of 0.5 bars to 5 bars, and all ranges and values there between including values 0.5 bars, 0.6 bars, 0.7 bars, 0.8 bars, 0.9 bars, 1.0 bars, 1.1 bars, 1.2 bars, 1.3 bars, 1.4 bars, 1.5 bars, 1.6 bars, 1.7 bars, 1.8 bars, 1.9 bars, 2.0 bars, 2.1 bars, 2.2 bars, 2.3 bars, 2.4 bars, 2.5 bars, 2.6 bars, 2.7 bars, 2.8 bars, 2.9 bars, 3.0 bars, 3.1 bars, 3.2 bars, 3.3 bars, 3.4 bars, 3.5 bars, 3.6 bars, 3.7 bars, 3.8 bars, 3.9 bars, 4.0 bars, 4.1 bars, 4.2 bars, 4.3 bars, 4.4 bars, 4.5 bars, 4.6 bars, 4.7 bars, 4.8 bars, 4.9 bars, and 5.0 bars.

In embodiments of the invention, for example, when catalytic cracking reactor 108 includes one or more of a fluidized bed reactor, a moving bed reactor, and a fixed bed reactor, the catalyst used in catalytic cracking reactor 108 may include a solid acid based zeolite catalyst selected from the list consisting of: one or more medium pore zeolites, including ZSM-5 and modified ZSM-5; one or more large pore zeolites, including zeolite Y and ultra-stable zeolite Y; and combinations thereof.

In embodiments of the invention, the yield of light olefins (C2 to C4) is in a range of 25 to 65 wt. %, preferably. The method of any of claims 1 to 18, wherein yield of light olefins (C2 to C4) is in a range of 35 to 65 wt. %.

Although embodiments of the present invention have been described with reference to blocks of FIG. 2, it should be appreciated that operation of the present invention is not limited to the particular blocks and/or the particular order of the blocks illustrated in FIG. 2. Accordingly, embodiments of the invention may provide functionality as described herein using various blocks in a sequence different than that of FIG. 2.

EXAMPLES

As part of the disclosure of the present invention, specific examples are included below. The examples are for illustrative purposes only and are not intended to limit the invention. Those of ordinary skill in the art will readily recognize parameters that can be changed or modified to yield essentially the same results.

A light naphtha feed having the composition shown in Table 1 was used as noted in the description of relevant Examples below.

TABLE 1

| Light Naphtha Composition Feed (LSRN) | |
|---|---|
| N-C5 | 28.8 |
| I-C5 | 11.8 |
| Cycl-C5 | 1.9 |
| N-C6 | 24.5 |
| I-C6 | 26.9 |
| Cycl-C6 | 4.6 |
| Benzene | 1.3 |

TABLE 1-continued

| Light Naphtha Composition Feed (LSRN) | |
|---|---|
| C7 | 0.3 |
| sum | 100 |

Example 1

Cracking with Fluidized Bed Pilot Plant

In Example 1, a catalyst was used to catalytically crack the light naphtha shown in Table 1 using a fluidized bed pilot plant. Reactor temperature, steam/feed ratio and residence time for the cracking of the light naphtha in the fluidized bed pilot plant are shown in Table 2. The experiment of Example 1 is based on a single pass. It should be noted that recycling $C_5$-gasoline to the reactor would increase the conversion and yields of light olefins shown in Table 2.

TABLE 2

| Light Naphtha Cracking Over Fluidized Reactors Reaction Conditions and Product Yields | |
|---|---|
| Temperature (° C.) | 670 |
| Steam/Feed (wt %) | 25 |
| Res. Time (sec) | 5 |
| C5-Gasoline, wt % | 34.6 |
| LCO + slurry + coke, wt % | 1.1 |
| Dry gases (C1-C3 paraffins + H2), wt % | 23 |
| light olefins, wt % | 30 |
| C4 (total), wt % | 11.3 |
| IC4=, wt % | 3.7 |
| C4=, wt % | 5.5 |

Example 2

Composition of C4 Stream from Steam Cracking Unit

In Example 2, the composition of the $C_4$ stream from the steam cracking unit is provided. The $C_4$ stream composition may depend on the feed to the catalytic cracker, process configuration, and downstream units. Table 3 shows the composition of $C_4$ stream from steam cracking.

TABLE 3

| $C_4$ composition from steam cracking | |
|---|---|
| Comp. | Conc. |
| Iso-Butene | 3.4 |
| N-Butane | 16.6 |
| Trans-2-Butene | 16.1 |
| 1-Butene | 33.6 |
| Iso-Butene | 24.1 |
| Cis-2-Butene | 6.2 |
| Total | 100.00 |

Example 3

Catalytic Cracking of $C_4$ to $C_6$ Olefinic Stream

In Example 3, the catalytic cracking of $C_4$ to $C_6$ olefinic stream carried out between 450 to 600° C. over zeolite based catalyst was considered. A simulated product distribution of cracking light naphtha and olefinic feed is shown in Table 4. The catalytic cracking can be done in single riser or in dual risers. The $C_4$ to $C_6$ olefinic stream is recycled to extinction. From the simulation, the yield of light olefin is increased to roughly around 40 wt. %. It should be noted that the yield can increase further if $C_2$ to $C_4$ paraffin is fed to a steam cracking process.

TABLE 4

Simulated product distribution from the proposed integration

| Comp. | Final Conc. |
|---|---|
| C1-C3 | 15.0 |
| Light olefins | 41.4 |
| C4 | 3.9 |
| CS-Gasoline | 37.2 |
| LCO + Coke + slurry | 2.5 |
| Total | 100.0 |

Although embodiments of the present application and their advantages have been described in detail, it should be understood that various changes, substitutions and alterations can be made herein without departing from the spirit and scope of the embodiments as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the above disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

The invention claimed is:

1. A method of producing olefins, the method comprising:

processing crude oil to produce a plurality of streams that include a hydrocarbon stream comprising primarily $C_5$ and $C_6$ hydrocarbons;

receiving, in a catalytic cracking reactor, the hydrocarbon stream comprising primarily $C_5$ and $C_6$ hydrocarbons;

receiving, in the catalytic cracking reactor, a $C_4$ to $C_5$ hydrocarbon stream from a steam cracking unit;

contacting, in the catalytic cracking reactor, a mixture of the hydrocarbon stream comprising primarily $C_5$ and $C_6$ hydrocarbons and the $C_4$ to $C_5$ hydrocarbon stream from the steam cracking unit with a catalyst under reaction conditions sufficient to produce an effluent comprising olefins; and separating the effluent to produce at least a first product stream comprising $C_2$ to $C_4$ olefins, a second product stream comprising $C_2$ to $C_4$ paraffins, and a third product stream comprising $C_{5+}$-gasoline;

wherein the reaction conditions include a reaction pressure in a range of 2.1 to 5.0 bars a residence time of reactants in the catalytic cracking reactor is in a range of 1 to 10 seconds, and a reaction temperature in a range of from 625° C. to 700° C.;

wherein the separating of the effluent further comprises producing a dry gas stream, and wherein the dry gas stream comprises methane and hydrogen.

2. The method of claim 1 further comprising:

receiving, in the catalytic cracking reactor, material comprising a coke precursor; and contacting, in the catalytic cracking reactor, a mixture comprising (1) the hydrocarbon stream comprising primarily $C_5$ and $C_6$ hydrocarbons, (2) the $C_4$ to $C_5$ hydrocarbon stream from the steam cracking unit, and (3) the material comprising the coke precursor with the catalyst under reaction conditions sufficient to produce coke and the effluent comprising olefins.

3. The method of claim 2, wherein the material comprising the coke precursor comprises fuel oil and/or diolefin from the steam cracking unit.

4. The method of any of claim 3, wherein the diolefin comprises butadiene.

5. The method of claim 1, wherein the catalytic cracking reactor is a fluidized bed reactor.

6. The method of claim 5, wherein the fluidized bed reactor includes a selection from the list consisting of: a riser, a downer, multiple risers, and multiple downers, and combinations thereof.

7. The method of claim 5, wherein a ratio of total hydrocarbon to catalyst in the fluidized bed reactor is 2 to 40 wt. %.

8. The method of claim 1, wherein the catalytic cracking reactor is a fixed bed reactor system.

9. The method of claim 8, wherein the fixed bed reactor system includes a selection from the list consisting of: a single fixed bed reactor, multiple reactors arranged in series, multiple reactors arranged in parallel, and combinations thereof.

10. The method of claim 1, wherein the reaction conditions include a reaction pressure in a range of 2.2 bars to 5 bars.

11. The method of claim 1, wherein the catalyst comprises a solid acid based zeolite catalyst selected from the list consisting of: one or more large pore zeolites, including zeolite Y and ultra-stable zeolite Y; and combinations thereof.

12. The method of claim 1, wherein a yield of the $C_2$ to $C_4$ olefins resulted from the contacting is in a range of 25 to 65 wt. %.

13. The method of claim 1, wherein a yield of the $C_2$ to $C_4$ olefins resulted from the contacting is in a range of 35 to 65 wt. %.

* * * * *